US006556413B1

(12) United States Patent
Rice et al.

(10) Patent No.: US 6,556,413 B1
(45) Date of Patent: Apr. 29, 2003

(54) METHOD OF PROVIDING ELECTRICAL CURRENT TO A CONTACTOR CIRCUIT

(75) Inventors: Julius Isaiah Rice, Raleigh, NC (US); Roger Alan Plemmons, Knightdale, NC (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/474,949

(22) Filed: Dec. 30, 1999

(51) Int. Cl.[7] ..... H01H 9/00
(52) U.S. Cl. ..... 361/160; 361/154
(58) Field of Search ..... 361/160, 154, 361/191

(56) References Cited

U.S. PATENT DOCUMENTS 4,603,370 A * 7/1986 Imazeki et al. ..... 361/155
5,510,951 A * 4/1996 Briedis et al. ..... 361/154
5,684,668 A * 11/1997 Muramatsu et al. ..... 361/185
6,091,596 A * 7/2000 Godfrey et al. ..... 361/154
6,101,082 A * 8/2000 Benkaroun et al. ..... 361/191

OTHER PUBLICATIONS

Full Voltage Contactors—NEMA Rated, pp. 12–12, 12–13; "Digest;" Oct., 1997; Square D.
3–Pole Non–Reversing Contactors, AC or DC Operating Coil; p. 14–2; "Digest;" Oct., 1997; Square D.
2– and 4– Pole Non–Reversing Contactors, AC or DC Operating Coil; p. 14–3 ; "Digest;" Oct., 1997; Square D.

* cited by examiner

*Primary Examiner*—Stephen W. Jackson
(74) *Attorney, Agent, or Firm*—Larry I. Golden; David R. Stacey; Larry T. Shrout

(57) ABSTRACT

A method for providing electrical current to a contactor circuit, by providing a power supply circuit having a power supply resistor, the power supply circuit supplies electrical current to the contactor circuit in response to the electrical specifications of the contactor; selecting a value for the power supply resistor in response to the contactor's electrical specifications and requirements of the contactor circuit; and, inserting the selected power supply resistor into the power supply circuit.

8 Claims, 2 Drawing Sheets

METHOD OF PROVIDING ELECTRICAL CURRENT TO A CONTACTOR CIRCUIT

DESCRIPTION

1. Technical Field

The present invention generally relates to contactor circuits. More specifically, to a method of providing electrical current to a contactor circuit having a power supply adaptable for use with several contactor coils having different electrical specifications.

2. Background of the Invention

Manufacturers are concerned with the cost of making products. Products may be redesigned so that they can be more easily made on existing equipment without the need for purchasing additional or special machinery. Similarly, manufacturers will attempt to design products having a single basic design with discrete elements that can be easily substituted or swapped.

Contactor circuits may include power supplies that are derived from the power existing within the coils of the contactor. The derived power supply is designed to provide a nominal current to the contactor.

Because the nominal current provided by a contactor coil may vary greatly depending upon the voltage of the coil being operated, a power supply circuit suitable for use with one coil may not be suitable for use with another coil having different electrical specifications i.e., voltage and current characteristics. For, example, a family of contactor coils having the same power specifications can have varying voltage and current specifications, thus, a lower voltage coil will require higher current to operate properly while a higher voltage coil requires less current.

Using a power supply circuit that provides excessive electrical current to the contactor circuit will stress the circuit's components and adversely affect their performance and life span. Prior to this present invention, a need existed to reduce manufacturing costs of power supply circuits for contactor coils.

This invention is designed to resolve these and other problems.

SUMMARY OF THE INVENTION

A power supply circuit is capable of shunting excess current away from a contactor circuit over a wide range of contactor coils used to derive the power supplied to the contactor circuit. The power supply circuit enables a contactor designer to use the same circuit in several different operating voltages and supply currents by simply changing the value of the power supply resistor. Placing the power supply resistor external from the power supply circuit allows the manufacture of a single electronic board assembly, thus reducing manufacturing costs. The power supply resistor can be installed into the assembly near the end of the manufacturing process dependent upon the contactor coil to be used.

The first embodiment of the present invention is directed to a method for providing electrical current to a contactor circuit, the steps comprising: providing a contactor; providing a power supply circuit having a power supply resistor, the power supply circuit supplies electrical current to the contactor circuit in response to the electrical specifications of the contactor; selecting a value for the power supply resistor in response to the contactor's electrical specifications and requirements of the contactor circuit; and inserting the selected power supply resistor into the power supply circuit.

Another embodiment of the present invention is directed to a method for providing current to a coil independent contactor circuit, the steps comprising: providing a contactor, the contactor having a holding coil; providing a power supply circuit having a power supply resistor, the power supply circuit supplies electrical current to the contactor circuit in response to the electrical current specification of the holding coil; selecting a power supply resistor in response to the holding coil's electrical specifications and requirements of the contactor circuit; and, inserting the selected power supply resistor into the power supply circuit.

The invention enables a manufacturer of contactor circuits with the ability to use the same power supply circuit with several different coils having different operating voltages and supply currents by simply changing the value of the power supply resistor. Placing the power supply resistor external from the power supply circuit enables the manufacturer to make a single, basic electronic board assembly that can be easily adapted for use with a variety of contactor coils having different electrical specifications. Mass production of a power supply circuit capable of being used for a variety of contactor coils reduces manufacturing costs.

Other advantages and aspects of the present invention will become apparent upon reading the following description of the drawings and detailed description of the invention.

DETAILED DESCRIPTION OF THE PREFERRED EMBODIMENT

Figure 1:
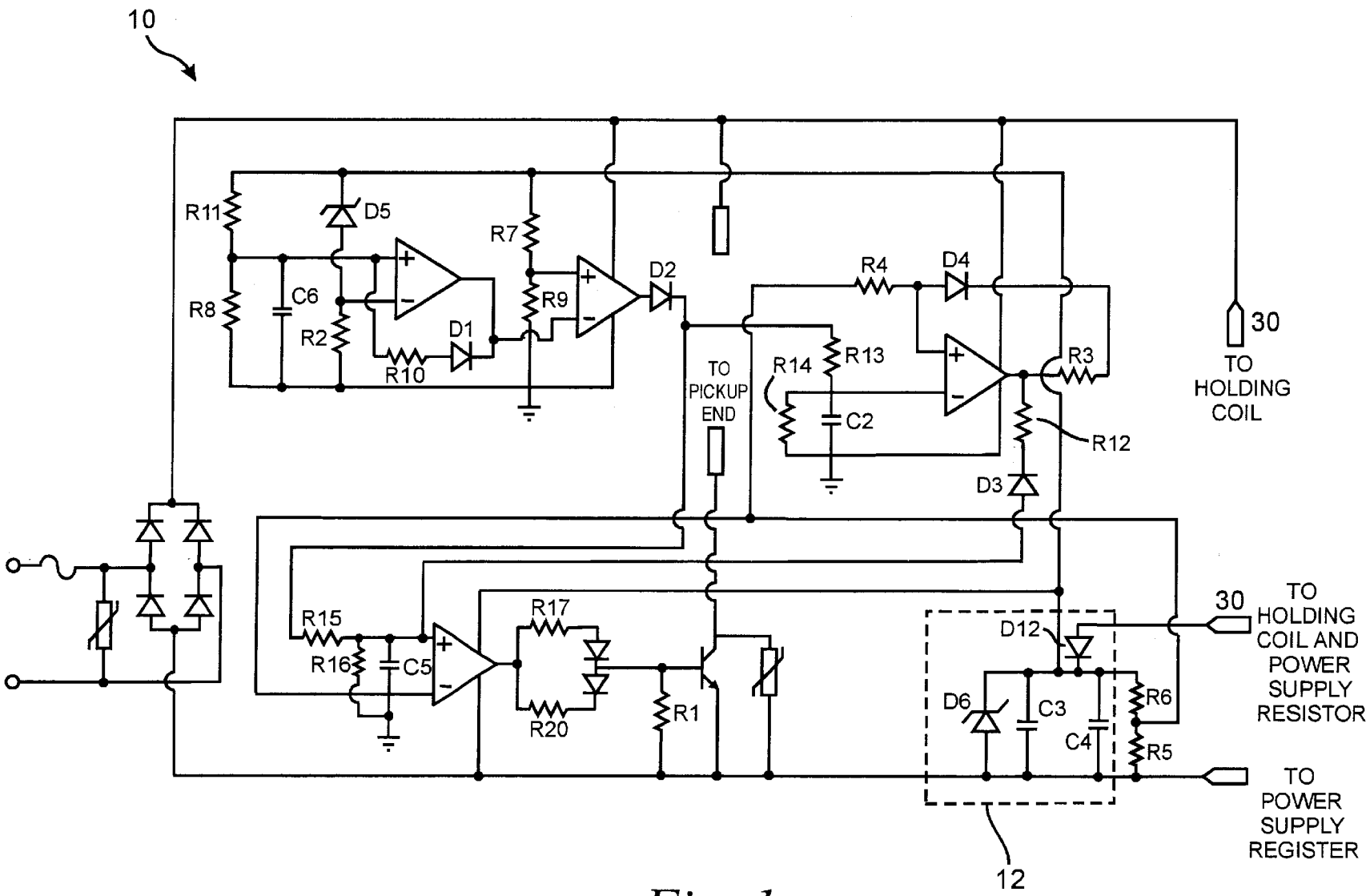
FIG. 1 is schematic diagram of a contactor circuit.
Figure 2:
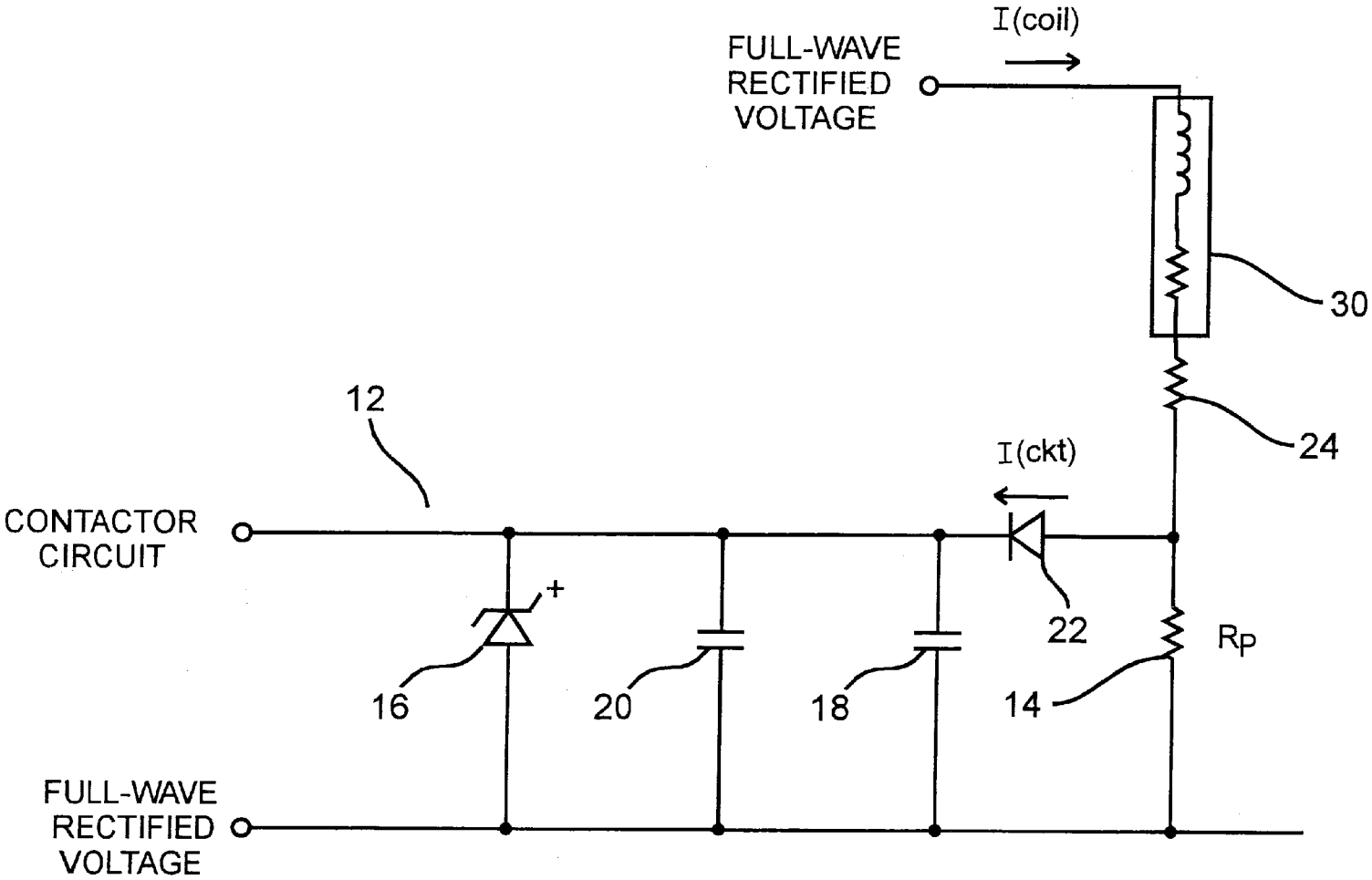
FIG. 2 is schematic diagram of a power supply for a contactor circuit.

While this invention is susceptible of embodiments in many different forms, there is shown in the drawings and will herein be described in detail preferred embodiments of the invention. The present disclosure is to be considered as an exemplification of the principles of the invention and is not intended to limit the broad aspect of the invention to the embodiments illustrated.

Typically, a contactor circuit 10 contains many components and sub-circuits, such as: a power supply 12, a timing circuit, a gating circuit, a power supply status circuit, an insulated gate bipolar transistor (IGBT) and metal oxide varistors (MOV) As shown in FIG. 1, the sub-circuits and components are operably connected.

A power supply circuit 12 is responsive to the holding coil 30 of the contactor circuit 10. The electrical current required by the coil 30 is "recycled" to power the electrical circuit of the contactor 10. Typically, electromechanical devices such as contactor coils will draw a large amount of current compared to electronic circuits. Using the coil 30 to develop the electronic power supply provides the circuit 10 with a large amount of available current.

Dependent upon the voltage parameter of the coil design, the amount of nominal current provided to the circuit 10 will vary. If one power supply circuit 12 is to be implemented with an entire voltage range of contactor coils, the contactor circuit 10 will encounter a wide range of current from the coil 30. For instance, a product line of 14.4 Watt contactor coils can have different voltage and current specifications, respectively, i.e., 480V, 30 mA, 120V, 120 mA, etc. The lower voltage coils require higher current to operate at the same power level while the higher voltage coils require less current. The large amount of current present with some coils 30, i.e., the lower voltage coils, will adversely affect the operation of the circuit 10. Excessive electrical current will heat up the electrical components and heat sinks may be required for the component to operate properly. The use of heat sinks will increase the amount of space required for the contactor circuit 10.

Selecting the appropriate power supply resistor 14 for each specific contactor holding coil 30 will shunt the excess current away from the contactor circuit 10, most notably the Zener voltage regulator 16. Providing the appropriate amount of current to the contactor circuit 10 allows the Zener diode 16 to remain cooler while maintaining the contactor's power up time the same as that for higher voltage coils. In addition, the contactor circuit 10 is usually encapsulated near the end of the manufacturing process. Encapsulation of the circuit 10 protects it against damage, humidity and moisture; but encapsulation also retains heat. Diverting the excess electrical current from the encapsulated circuit 10 will reduce the strain on the circuit's 10 components.

Since the power supply is derived from the contactor holding coil 30, the operating voltage and current is susceptible to variations related to the transient inductance associated with the coil 30. The power supply consists of two capacitors 18, 20, a Zener diode 16, a blocking diode 22 and the remotely located power supply resistor 14. The Zener diode 16 is at the output of the circuit and supplies the voltage reference to the contactor circuit 10. Although the Zener diode 16 will also shunt away excess current that the capacitor or the power supply resistor do not require, this situation is not desirable because the excess current will deteriorate the operability of the Zener diode 16.

The power supply is developed from a full-wave rectified AC voltage. Since full-wave rectified signals frequently have a large amount of ripple, the smoothing capacitor 18 (22 $\mu$F), smooths the rippled full-wave voltage signal into a DC signal. The filtering capacitor 20 (1 $\mu$F), preferably ceramic, filters out high frequency noise.

The blocking diode 22 prevents the capacitors 18, 20 from discharging when the full-wave rectified line voltage is at low values. If this diode 20 was not present, the capacitor 18 would track the incoming ripple rather than smooth it out.

The equations for the current supplied to the contactor circuit are listed below:

$$I(ckt) = I(coil) - \frac{V(D6) + Vf(D12)}{Rp} = I(coil) - \frac{16.0 + 0.7}{Rp} = I(coil) - \frac{16.7}{Rp}$$

I(coil) is set by the coil design and is dictated by the electromechanical design of the contactor coil 30. The power supply resistor 14 allows for the circuit designer to control how much coil current the power supply circuit 12 provides. The contactor circuit current can be less than or equal to the coil current, but it cannot be greater.

Another resistor 24, an economizing resistor, can be connected in series with the holding coil 30. The combined resistance of the holding coil 30 and the economizing resistor 24 act as a dropping resistor for the power supply circuit 12. The economizing resistor 24 is not necessary from a design aspect, however, the resistor 24 can be implemented to increase the total resistance of the holding coil circuit without having to use smaller gauge wire or more turns of wire for the coil 30.

We claim:

1. A method for providing electrical current to a contactor circuit, the steps comprising:

providing a contactor having a coil;

providing a printed wiring board on which the contactor circuit is located;

providing a power supply circuit located on the printed wiring board, the power supply circuit receiving electrical current from the contactor coil and supplying power to the contactor circuit;

selecting a power supply resistor having a resistance value determined by the contactor coil's electrical specifications and current requirements of the contactor circuit; and electrically connecting the power supply resistor to the power supply circuit, the power supply resistor being located remotely from the printed wiring board.

2. The method of claim 1 wherein the power supply circuit includes:

an input electrically connected to the contactor coil, the input operably connected to an anode of a blocking diode and the power supply resistor; and an output operably connected to the cathode of the blocking resistor, a filtering capacitor, a smoothing capacitor and a cathode of a voltage regulating diode, wherein the contactor circuit is responsive to the output.

3. A method for providing electrical current to a contactor circuit, the steps comprising:

providing a contactor, the contactor having a holding coil;

providing a printed wiring board on which the contactor circuit is located;

providing a power supply circuit located on the printed wiring board and supplying power to the contactor circuit, the power supply circuit receiving electrical current from the contactor holding coil;

selecting a power supply resistor having a resistance value determined by the electrical specifications of the holding coil and current requirements of the contactor circuit; and electrically connecting the power supply resistor to the power supply circuit, the power supply resistor being located remotely from the printed wiring board.

4. The method of claim 3 wherein the power supply circuit includes:

an input electrically connected to the holding coil, the input operably connected to an anode of a blocking diode and the power supply resistor; and an output operably connected to the cathode of the blocking resistor, a filtering capacitor, a smoothing capacitor and a cathode of a voltage regulating diode, wherein the contactor circuit is responsive to the output.

5. A method for providing electrical current to a contactor circuit, the steps comprising:

selecting an electrical contactor;

providing a preassembled printed wiring board on which the contactor circuit and a power supply circuit are located, the power supply circuit supplying electrical current to the contactor circuit and receiving electrical current from the contactor's coil circuit;

selecting a power supply resistor having a resistance value determined by the electrical specifications of the selected contactor and the current requirements of the contactor circuit; and connecting the power supply resistor to the power supply circuit electrically, the power supply resistor being located remotely from the printed wiring board.

6. The method of claim 5, wherein the power supply circuit includes:

an input electrically connected to the contactor's coil, the input electrically connected to an anode of a blocking diode and the power supply resistor; and an output electrically connected to the cathode of the blocking resistor, a filtering capacitor, a smoothing capacitor and a cathode of a voltage regulating diode.

7. A method for providing electrical current to a contactor circuit, the steps comprising:

selecting an electrical contactor having a holding coil;

providing a preassembled printed wiring board on which the contactor circuit and a power supply circuit are located, the power supply circuit receiving electrical current from the holding coil;

selecting a power supply resistor having a resistance value determined by the electrical specifications of the holding coil and the current requirements of the contactor circuit; and connecting the power supply resistor to the power supply circuit electrically, the power supply resistor being located remotely from the printed wiring board.

8. The method of claim 7, wherein the power supply circuit includes:

an input electrically connected to the holding coil, the input electrically connected to an anode of a blocking diode and the power supply resistor; and an output electrically connected to the cathode of the blocking resistor, a filtering capacitor, a smoothing capacitor and a cathode of a voltage regulating diode.

* * * * *